US005115575A

United States Patent [19]

Journet et al.

[11] Patent Number: 5,115,575

[45] Date of Patent: May 26, 1992

[54] AUTOMATED METHOD FOR THE CYCLIC OPERATION OF A CENTRIFUGAL DRIER

[75] Inventors: Gérard Journet, Coutiches; Nicolas Francou, Hellemmes, both of France

[73] Assignee: Fives-Cail Babcock, Montreuil, France

[21] Appl. No.: 542,199

[22] Filed: Jun. 21, 1990

[30] Foreign Application Priority Data

Jun. 29, 1989 [FR] France ..... 89 08714

[51] Int. Cl.[5] ..... F26B 5/08

[52] U.S. Cl. ..... 34/8; 34/45; 34/56; 494/29; 494/37

[58] Field of Search ..... 494/27, 29, 37; 34/8, 34/58, 12, 45, 55, 56, 60

*Primary Examiner*—Henry A. Bennet

*Attorney, Agent, or Firm*—Collard, Roe & Galgano

[57] ABSTRACT

A method for the automatic operation of a centrifugal drier comprising a rotary cylindrical screening basket and which is operated cyclically in successive cycles whose rhythm is a function of the flow of the product to be dried and each of which includes the stages of charging the basket with the product containing a particulate solid material, accelerating the rotary basket for centrifugally separating liquid from the solid mataerial to obtain the solid material in predried form, washing the predried solid material with a washing liquid, maintaining the basket at a constant rotary speed until the solid material has been completely dried, decelerating the rotary basket and discharging the dried solid material from the basket at a low rotary speed, which comprises, at the end of each cycle, the steps of fixing the duration of the stage of completely drying the solid material as a function of the time available for the following cycle to reduce the time interval between two successive cycles to a minimum, and determining the quantity of the washing liquid to be used in the following cycle as a function of the duration of said stage.

7 Claims, 2 Drawing Sheets

AUTOMATED METHOD FOR THE CYCLIC OPERATION OF A CENTRIFUGAL DRIER

BACKGROUND OF THE INVENTION

The present invention relates to a centrifugal drier comprising a rotary cylindrical screening basket and operated cyclically in successive, repetitive cycles in the course of which a product to be dried is charged into the basket under control of a device which interrupts the feeding of the product into the basket when the layer of the product on the cylindrical wall of the rotating basket has reached a predetermined thickness, the product is then partially dried initially as the basket rotates and particulate solid material contained in the product is retained on the basket wall while liquid is centrifugally separated from the product, the partially dried product is washed with a washing liquid projected by an array of orifices or atomizing nozzles disposed in the interior of the basket, and the washed product is finally completely dried, discharged from the basket and removed. Such centrifugal driers have been used in the sugar industry for separating sugar crystals (the particulate solid material) from massecuite (product to be dried).

Each operating cycle of such centrifugal driers is defined by a certain number of parameters, such as acceleration and deceleration of the basket rotation, as well as timing, etc. At the present time, each operating parameter is entered separately into the computer which automatically operates the drier, either by the manufacturer or by the operator, and these parameters are then adjusted empirically on the basis of the operating experience.

If the drier operates with a constant charge, its cyclic rythm depends on the flowrate of the product to be dried.

In present drying installations, the duration of each drying cycle is predetermined and constant, and the operation of the installation is adapted to the flowrate while taking into account the time interval between the end of one operating cycle and the beginning of the following cycle.

SUMMARY OF THE INVENTION

It is the primary object of this invention to optimize the drying by making the best use of the time available for each cycle.

This and other objects are accomplished according to the invention in a method for the automatic operation of a centrifugal drier comprising a rotary cylindrical screening basket and which is operated cyclically in successive cycles whose rythm is a function of the flow of the product to be dried and each of which includes the stages of charging the basket with the product containing a particulate solid material, accelerating the rotary basket for centrifugally separating liquid from the solid material to obtain the solid material in predried form, washing the predried solid material with a washing liquid, maintaining the basket at a constant rotary speed until the solid material has been completely dried, decelerating the rotary basket and discharging the dried solid material from the basket at a low rotary speed, by the steps, at the end of each cycle, of fixing the duration of the stage of completely drying the solid material as a function of the time available for the following cycle to reduce the time interval between two successive cycles to a minimum, and determining the quantity of the washing liquid to be used in the following cycle as a function of the duration of said stage.

It has been found that it is possible to reduce the volume of the washing liquid utilized in each operating cycle if the drying time is increased. By extending the final drying time in each cycle to the maximum, the method of this invention enables the consumption of washing liquid to be reduced to a minimum and, consequently, to effectuate considerable operating economies, which is particularly true when the collected washing liquid must be processed subsequently to recover products entrained thereby or dissolved therein, as is the case with the drying of massecuite in the production of sugar. If the washing liquid is fed at a constant rate, the duration of the washing stage of the following cycle will be determined at the end of each cycle. On the other hand, if the duration of the time of the washing stage is maintained constant, the flowrate of the washing liquid will be varied so that the desired quantity of washing liquid will be used.

To determine the volume of washing liquid, a formula linking this parameter to the duration of the complete drying stage will be used, which formula has been experimentally pre-established. This formula may be, for example, a linear relation.

BRIEF DESCRIPTION OF DRAWING

The above and other objects, advantages and features of the present invention will become more apparent from the following description of a now preferred embodiment, in conjunction with the accompanying drawing wherein.

DETAILED DESCRIPTION OF PREFERRED EMBODIMENTS

Figure 1:
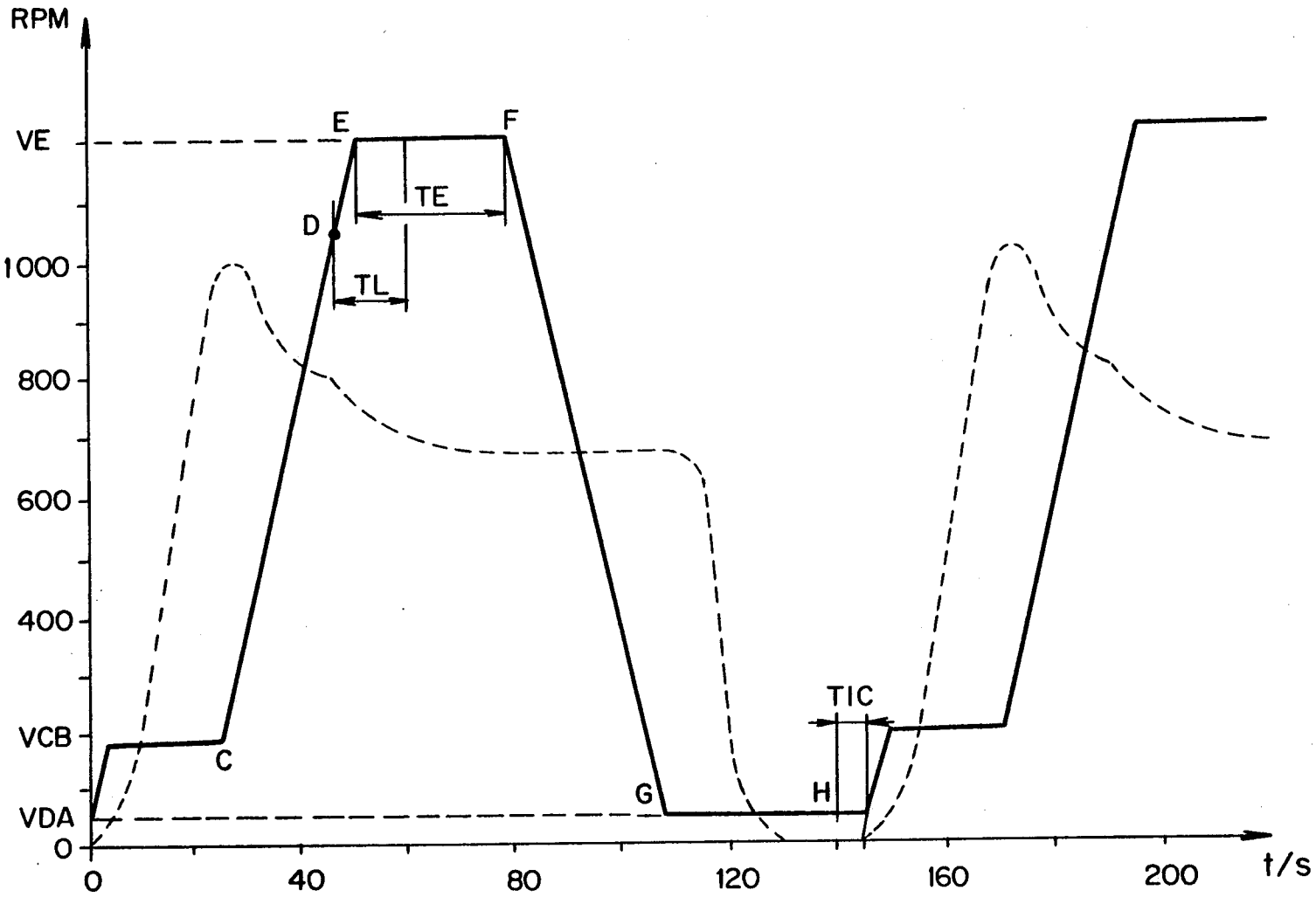
FIG. 1 is a graph showing an operating cycle of a centrifugal drier of the indicated type, including a curve indicating the variations of the product layer thickness in the rotating drier basket as a function of the time.

Referring first to FIG. 1, the abscissa of the graph shows the time in seconds and the ordinate is the speed of the rotation of the screening basket in turns per minutes. The illustrated operating cycle comprises stage of acceleration AB, stage BC of charging the basket with the product containing a particulate solid material at constant rotary speed VC, stage CE of accelerating the rotary basket for centrifugally separating liquid from the solid material to obtain the solid material in predried form, a stage beginning at D of washing the predried solid material with a washing liquid, maintaining the basket at constant rotary speed VE in stage EF until the solid material has been completely dried, stage of deceleration FG and stage GH of discharging the dried solid material from the basket at low constant rotary speed VD.

At the end of each operating cycle, the time in seconds available for the following cycle is determined on the basis of the following formula:

$$TCD = \frac{3600 \times N \times Ch}{Q} - TIC \qquad (1)$$

wherein

N is the number of available driers,

Ch is the imposed charge of the basket in cubic meters,

Q is the flowrate of the product charged into the basket in cubic meters/hour, and TIC is a safety margin of 2 to 30 seconds provided between the end of one cycle and the beginning of the following cycle.

The Value of Q may be derived, for example, from a system controlling the production plant upstream of the drier or from a level indicator in a storage tank or a mixer feeding the drier with the mixed product.

If calculated value TCD is more or less than the time tH-tA of the preceding cycle, the time of the duration TE of stage EF of completely drying the solid material is fixed to be respectively shorter or longer so that the total time of the operating cycle is equal to TCD while the times of the other stages of the cycle remain constant. In other words, the drying time TE is fixed as a function of the time available for the following cycle to reduce the time interval between two successive cycles to a minimum. At the same time, the quantity of the washing liquid to be used in the following cycle is determined at a new level as a function of the duration of the complete drying stage.

Figure 2:
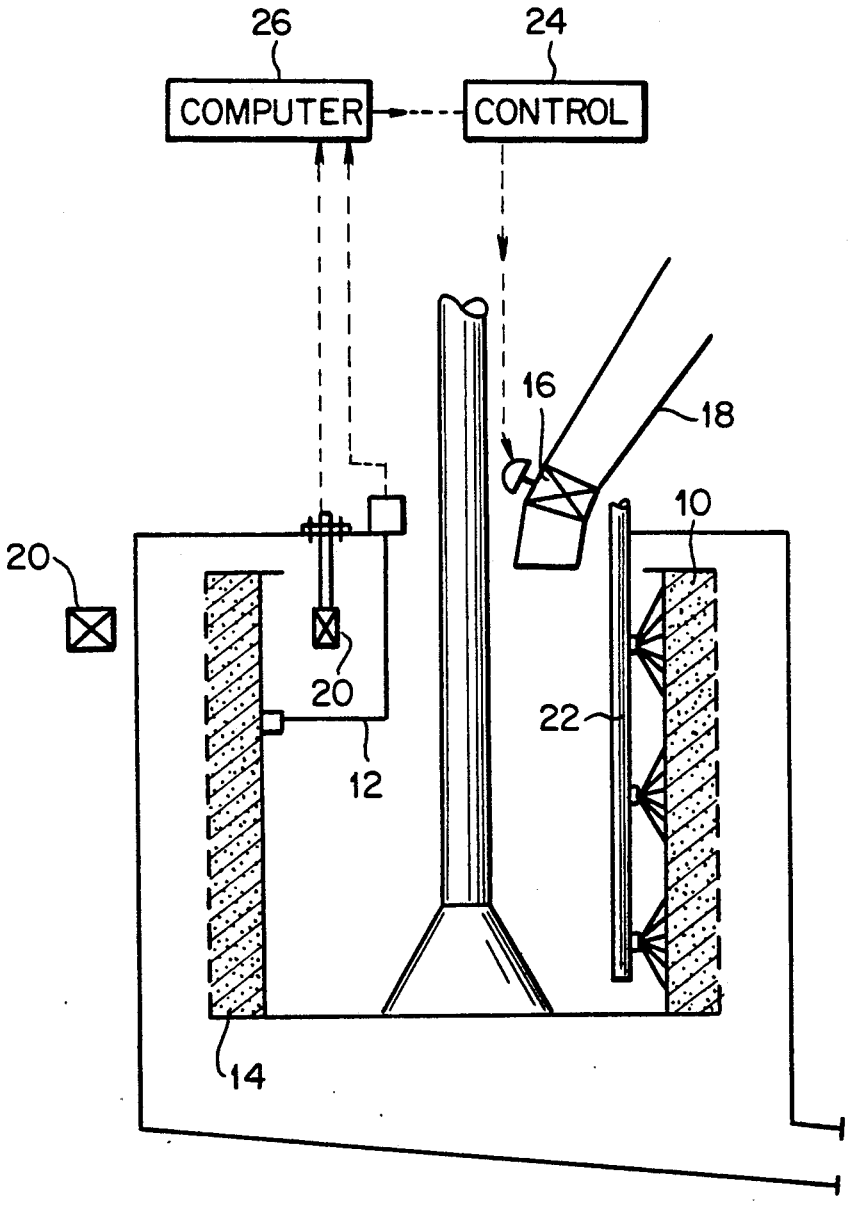
FIG. 2 is a schematic illustration of the drier in vertical section.

As shown in FIG. 2, the washing liquid is projected onto layer 14 of the partially dried product in rotary cylindrical screening basket 10 by array 22 of spraying nozzles. Practically, the flowrate of the washing liquid is maintained constant and the new value for the duration TL of the washing stage will be fixed to take into account the new value of the duration of the operating cycle.

For example, if time TCD available for the following cycle is more than 10 seconds in excess of the duration of the preceding cycle, the duration TE of the complete drying stage is increased by 10 seconds and the duration TL of the washing stage is reduced by one second. Inversely, if TCD is less than the duration of the last operating cycle, TE is reduced and TL is increased. The formula linking the variations of TE and of TL is experimentally established on the basis of a series of experiments so that the quality of the dried product remains unchanged for all retained values. For example, a linear relation may be adopted.

In a modified embodiment, the quantity of the washing liquid is maintained proportional to the mass of the basket load, in which case the coefficient of proportionality may be changed to modify this quantity.

Duration TE of the final drying stage and duration TL of the washing stage, i.e. the quantity of the utilized washing liquid projected at a constant flowrate, are maintained within predetermined maximum and minimum limits.

To maintain charge 14 in screening basket 10 at imposed value Ch, sensor 12 is disposed in the interior of the basket to sense the thickness of the layer of the charged product formed along the wall of the rotating cylindrical basket. As soon as feeding of the product into basket 10 through charging channel 18 has begun, sensor 12 is applied to the layer of the charge product and when the thickness of the layer reaches a predetermined control value stored in computer 26, to which sensor 12 is connected, this computer will transmit a control signal to control 24 connected to valve 16 to close the valve and prevent further product from being charged into the basket.

Normally, the charge of the basket is maintained at a maximum value in each drying cycle, which is determined by the structure of the centrifugal drier, because this keeps the productivity of the drier at a maximum. In effect, the quantities of liquid used in each cycle for washing the feeding channel through which the product is charged into the basket, the rotary basket and the fixed casing of the drier remain the same, regardless of the charge. Therefore, what is of interest for a given flow of product to be dried is to increase the charge of the basket to a maximum value to reduce the number of operatinq cycles and, consequently, to reduce the consumption of washing liquid.

It should be noted that there is no purpose in extending duration TE of the final drying stage above a maximum duration TEM because once this maximum final drying time has been reached, the quality of the dried product will not further improve. As a matter of fact, such an excessive drying time may even have disadvantages, particularly in the case of sugar processing, because the dried layer on the basket wall may harden to a point where it becomes difficult to discharge the dried product from the basket.

Therefore, when the fixed duration TE of the final drying stage exceeds predetermined maximum value TEM, a new basket charge value lower than the maximum charge is determined for the following cycle to permit TE to be maintained at a level inferior, or at most equal, to TEM.

This new basket charge value may be calculated on the basis of the following formula:

$$Ch = \frac{Q \times (TCDM + TIC)}{3600 \times N} \quad (2)$$

wherein

Q, TIC and N are the same as in formula (1) and TCDM corresponds to the duration of a cycle comprising a final drying stage of predetermined maximum value TEM.

A new control value for the thickness of the layer of product 14 is fixed on the basis of this new value Ch.

If the volume of the washing liquid is maintained proportional to the charge in the basket, it will be reduced automatically with the volume of the charge.

If the flow of the product to be dried is again increased, and the calculated value of Ch increases to become equal, or superior, to the maximum charge, one returns to the first mode of operation by calculating TCD by means of formula (1) and maintaining the charge in the basket at its maximum value.

The curve reflecting the variations of the thickness of the product in the basket during one operating cycle is represented in broken lines as a function of time, in FIG. 1, and is traced for each cycle on the basis of the information provided by sensor 12 or a gamma-densimeter 20 whose radiation traverses the product layer.

All the calculations are made automatically by computer 26 which receives the required data by suitable inputs, and the calculated control signals are transmitted to the inputs of control 24 which operates the various structural components of the centrifugal drier, such as the motor entraining rotary basket 10, valve 16 in charging funnel 18, thickness sensor 12, etc.

What is claimed is:

1. A method for the automatic operation of a centrifugal drier comprising a rotary cylindrical screening basket and which is operated cyclically in successive cycles whose rhythm is a function of the flow rate of the product to be dried and wherein each cycle includes the stages of charging the basket with the product containing a particulate solid material, accelerating the rotary basket for centrifugally separating liquid from the solid material to obtain the solid material in predried form, washing the predried solid material with a washing liquid, maintaining the basket at a constant rotary speed until the solid material has been completely dried, decelerating the rotary basket and discharging the dried solid material from the basket at a low rotary speed, which method comprises, at the end of each cycle, the steps of (a) determining the duration of the next successive cycle so as to reduce the time interval between two successive cycles to a minimum, (b) calculating the duration of the stage of completely drying the solid material as a function of the duration of the next successive cycle, and (d) determining the quantity of the washing liquid to be used in the next successive cycle as a function of the duration of said stage.

2. The method of claim 1, comprising the further steps of projecting the washing liquid at a constant flowrate onto the product charged into the rotary basket, and fixing the duration of the washing stage so that the quantity of the utilized washing fluid is equal to the determined quantity.

3. The method of claim 1, comprising the further steps of maintaining the duration of the washing stage constant, and controlling the flowrate of the washing fluid so that the quantity of the utilized washing fluid is equal to the determined quantity.

4. The method of claim 1, comprising the further step of maintaining the duration of the final drying stage and the quantity of the utilized washing liquid within predetermined upper and lower limiting values.

5. The method of claim 1, wherein the duration of the next successive cycle is determined on the basis of the flowrate of the product charged into the rotary basket and a predetermined basket charge value.

6. The method of claim 5 comprising the further steps of comparing the calculated duration of the stage of completely drying the solid material to a predetermined maximum value corresponding to a predetermined duration of a cycle, and determining a new basket charge value corresponding to said predetermined cycle duration when the calculated duration exceeds the predetermined maximum value.

7. The method of claim 6, comprising the further step of maintaining the quantity of the washing liquid proportional to the charged product.

* * * * *